US007658445B2

(12) United States Patent
Mittler et al.

(10) Patent No.: US 7,658,445 B2
(45) Date of Patent: Feb. 9, 2010

(54) CHAIR SLED LOCKING MECHANISM FOR GAMING DEVICE

(75) Inventors: Jon P. Mittler, Reno, NV (US); Voytek Chwalisz, Carson City, NV (US); Tai Rosander, Reno, NV (US); Bradley Hemerick, Sparks, NV (US); James Gray, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 11/951,862

(22) Filed: Dec. 6, 2007

(65) Prior Publication Data

US 2009/0146484 A1 Jun. 11, 2009

(51) Int. Cl.
*A47C 7/62* (2006.01)

(52) U.S. Cl. ..... 297/217.3; 297/217.7

(58) Field of Classification Search ..... 297/217.7, 297/172, 217.3, 217.1, 217.4; 292/303, 304; 248/503.1, 500, 501, 510, 680
See application file for complete search history.

(56) References Cited

U.S. PATENT DOCUMENTS 3,734,561 A 5/1973 Barecki et al.
4,893,850 A * 1/1990 Mizusawa ..... 292/128
5,083,738 A 1/1992 Infanti
5,102,192 A * 4/1992 Barile, Sr. ..... 297/257
5,409,296 A 4/1995 Barile
5,522,641 A 6/1996 Infanti
5,542,748 A 8/1996 Barile
5,762,617 A 6/1998 Infanti
5,791,731 A 8/1998 Infanti
5,807,177 A 9/1998 Takemoto et al.
6,354,660 B1 3/2002 Friedrich
6,502,800 B1 1/2003 Ursini et al.
6,572,187 B2 * 6/2003 Laufer ..... 297/217.1
7,407,228 B1 * 8/2008 Infanti ..... 297/217.7
2008/0039215 A1 * 2/2008 Hahn ..... 463/47
2008/0246321 A1 * 10/2008 Canterbury ..... 297/217.4

* cited by examiner

*Primary Examiner*—Milton Nelson, Jr.
(74) *Attorney, Agent, or Firm*—Armstrong Teasdale LLP

(57) ABSTRACT

Provided in embodiments of the present invention is a chair sled locking mechanism for use with a gaming device. In one example embodiment, a chair sled includes a sled body having a chair attachment connector disposed at a first end of the sled body and a cavity disposed at a second end of the sled body. A latching unit is disposed in the cavity of the sled body along with a spring that is configured to hold the latching unit in a locked position. A latch cover covers the cavity of the sled body. At least one of the latch cover or sled body includes an opening that allows an operator to manipulate the latching unit to an unlocked position.

23 Claims, 8 Drawing Sheets

CHAIR SLED LOCKING MECHANISM FOR GAMING DEVICE

FIELD OF THE INVENTION

The present invention relates generally to chair locking mechanism for use with a gaming device, and more particularly to chair sled coupling a gaming chair to a gaming device with an improved quick-release locking mechanism.

BACKGROUND

Although gaming has existed in some form for many years, its present familiar form of slot devices, table games, sports books, etc. has mainly developed in the last few decades. During this development process, the need to make gaming stations comfortable for the player was recognized. These comfort improvements were advantageous to gaming casinos and other gaming businesses because it encouraged players to play for longer amounts of time. Gaming chairs were a major part of this development because they provide both support and comfort to players playing the gaming machines. Additionally, chairs allow gaming players with limited mobility or strength to comfortably position themselves during game play at a gaming device.

The gaming establishments, however, realized that although chairs provided a comfort increase for players, there were certain disadvantages to having them present. One disadvantage is that the presence of chairs takes up valuable floor space and can crowd aisles between gaming machines. This often means that banks of gaming machines must be separated by a greater margin to allow the chairs to fit into the aisles between the gaming machine banks. Another disadvantage is that the presence of chairs makes cleaning the floors and machines more difficult. The chairs must be moved to allow vacuums easy passage and allow cleaning staff to clean the faces of the gaming machines. Although not a problem on the same scale of the cleaning issues, slot technicians must also often move the chairs to access the gaming devices. A further disadvantage is that chairs separate from the gaming machines are relatively mobile resulting in various dangerous situations. For example, a careless or inebriated player may tilt back on a separated chair and fall over, which provides a risk both to that player and other people in the immediate vicinity. Other examples may include situations where angry or frustrated players attempt to pick up or throw the separated chairs. In addition to these more dangerous situations, chairs that are separated from the gaming machines may be moved and misplaced.

To address some of these problems, some gaming jurisdictions and casinos require that gaming chairs be physically attached to the gaming devices. This is typically done through a metal plate that attaches to the base of the gaming machine and the base of the chair. Since one of the goals of this setup is to prevent players from purposefully removing the chair, the physical connections between the chair, metal plate, and gaming device are generally structured to prevent players from being able to disconnect the chairs from the gaming devices. However, to accomplish this structure, the physical connections are generally very difficult and cumbersome for casino personnel to remove. This difficulty slows down gaming machine movement on a gaming floor during reorganizations of gaming floors and can make access to the lower doors of the gaming device difficult during routine maintenance or other repairs.

In addition, conventional chair connection systems include a mechanical latch to retain the chair in the gaming machine.

That is, the metal plate generally has a hook or pin that fits into and interfaces with a latch located in the base of a gaming machine. This additional mechanical system in gaming devices, however, increases the cost of manufacturing the gaming machines due to the additional parts needed for the latch system. Since only some jurisdictions and casinos require that the chair be attached to the gaming device, this additional manufacturing cost becomes needless if all machines are manufactured with the latch system. However, if only a portion of the gaming machines are fitted with a latch, potentially costly adjustments must be made to the manufacturing process to accommodate both styles of gaming machines (i.e., ones without the latch system and ones with the latch system). Additionally, if there is a mechanical problem with the latch system, the entire game has to be taken out of service for repair, which can cost the casino potential revenue.

Conventional latching systems also generally have a raised portion at the connection point with the machine to facilitate an area for the latch pin or hook. This raised portion, however, can interfere with a player's foot room and can be incompatible with gaming devices that have a low profile base. Further, some conventional latching systems require an attachment point to the casino floor to prevent lateral or vertical movement (rocking) of the chair and metal plate. This requirement adds additional complexity and cost for a casino and limits the possible game floor arrangements of the gaming machines.

These and other problems in conventional gaming devices are addressed by embodiments of the present invention.

SUMMARY

Embodiments of the present invention provide a chair sled locking mechanism configured to fixedly couple a gaming chair to an electronic gaming device via a quick-release low-profile locking mechanism. In one embodiment, a chair sled includes a sled body having a chair attachment connector disposed at a first end of the sled body and a cavity disposed at a second end of the sled body. A latching unit is disposed in the cavity of the sled body along with a spring that is configured to hold the latching unit in a locked position. A latch cover covers the cavity of the sled body. At least one of the latch cover or sled body includes an opening that allows an operator to manipulate the latching unit to an unlocked position.

DETAILED DESCRIPTION

Figure 1A:
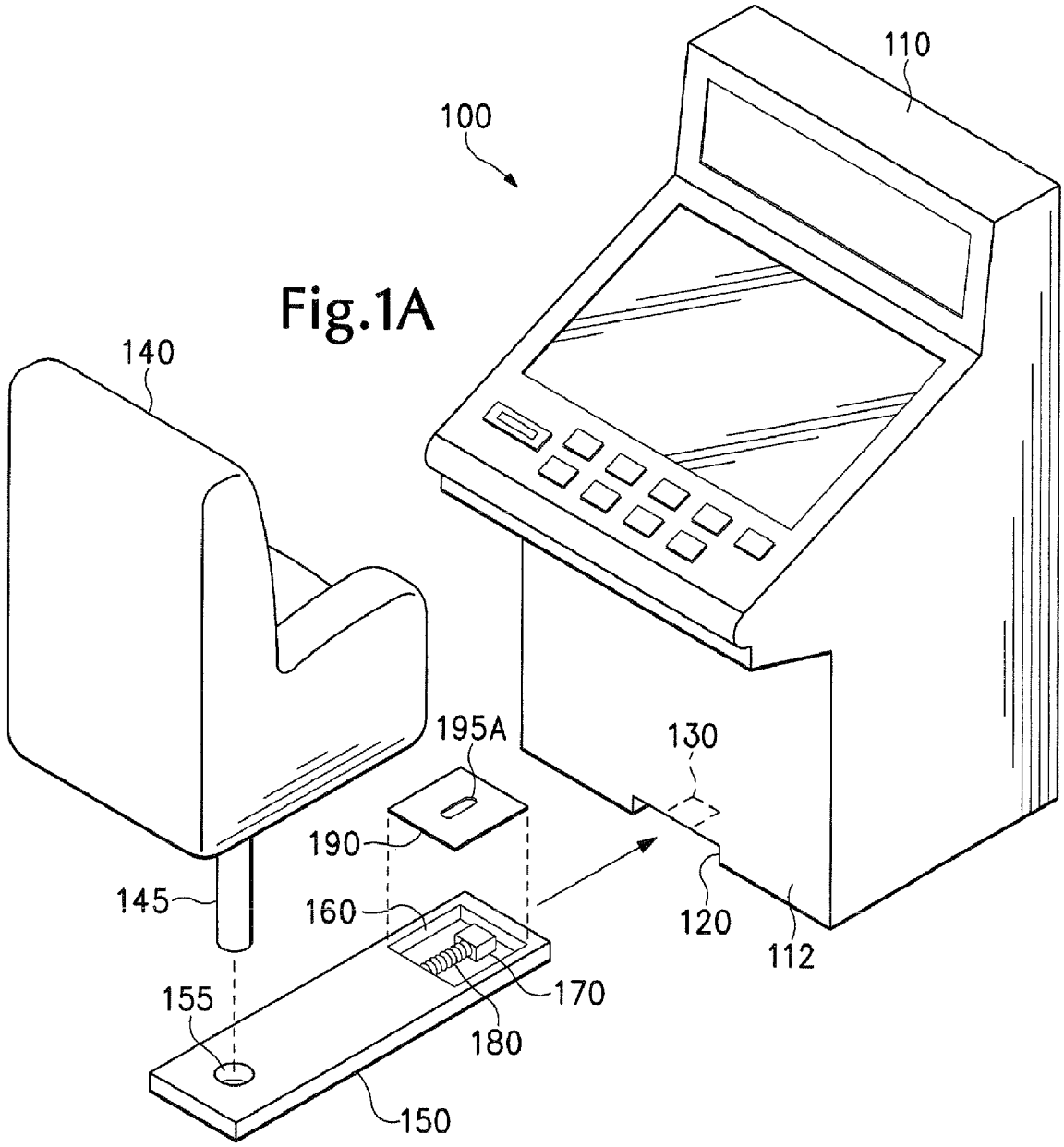
FIG. 1A illustrates an isometric view of a chair sled with a gaming device according to an embodiment of the present invention.

To address the problems discussed above and other problems, embodiments of the present invention are directed to a chair sled configured to fixedly couple a gaming chair to an electronic gaming device via a quick-release locking mechanism. Some of these embodiments are described below in detail, and in addition, some specific details are shown for purposes of illustrating the inventive principles. However, numerous other arrangements may be devised in accordance with the inventive principles of this patent disclosure. Thus, while the present invention is described in conjunction with the specific embodiments illustrated in the drawings, it is not limited to these embodiments or drawings. Rather, it is intended to cover alternatives, modifications, and equivalents that come within the scope and spirit of the inventive principles set out in the appended claims. Further, well-known processes have not been described in detail in order not to obscure the present invention. Thus, the inventive principles are not limited to the specific details disclosed herein.

Some of the embodiments of the present invention are directed to a chair sled that efficiently and effectively allows a gaming chair to be coupled to a gaming device. Unlike conventional chair sleds, these embodiments include a latching mechanism in the body of the chair sled rather than in the gaming device itself. This feature allows the gaming devices to be manufactured without costly extra latching parts if they are not required by a gaming jurisdiction or desired by a gaming establishment. In addition, these embodiments keep the cross-sectional profile of the chair sled relatively thin, which allows the sled to be used with gaming devices that have low profile base portions. Some to these embodiments also require a specific type of tool to release the latching mechanism, which helps prevent players or other non-authorized personnel from detaching the chairs from the gaming devices. Additional advantages of these embodiments are also present. Although some of these advantages are described below, additional advantages not necessarily described will be recognized by one skilled in the art.

Figure 1B:
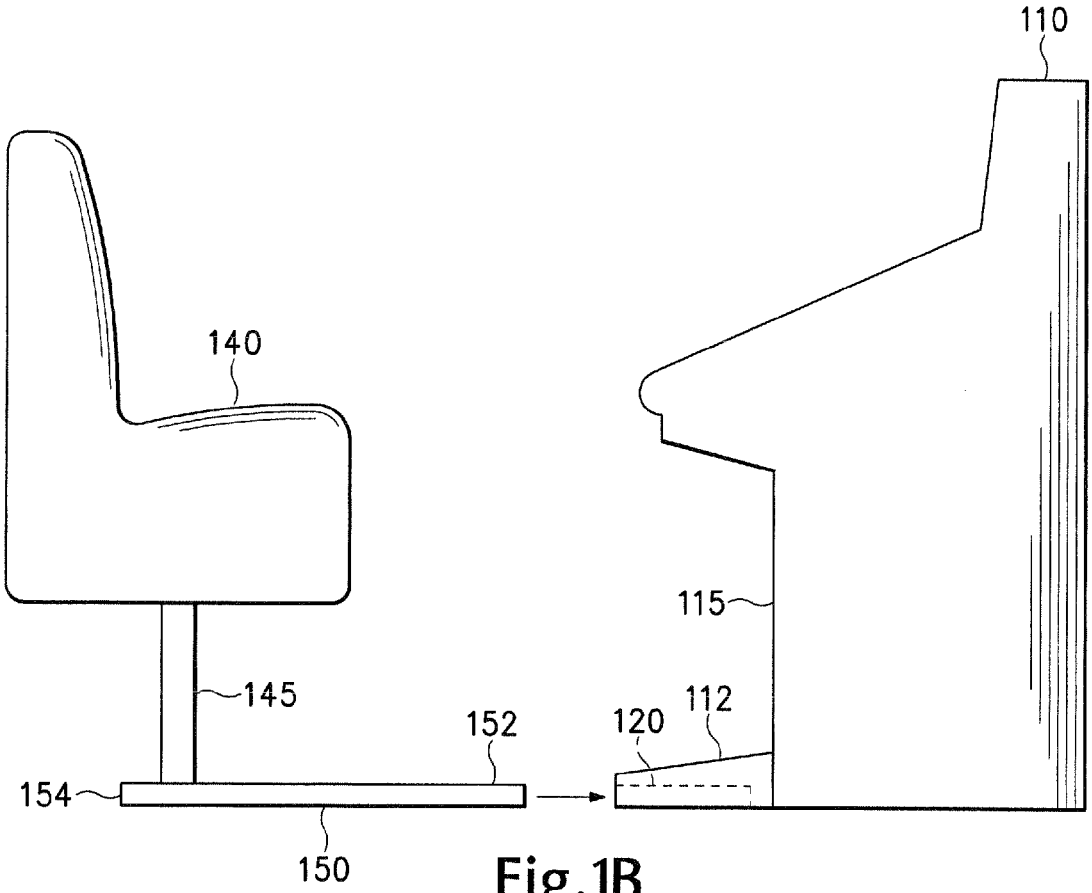
FIG. 1B illustrates a side view of chair sled with a gaming device according to an embodiment of the present invention.

FIG. 1A illustrates an isometric view of a chair sled with a gaming device according to an embodiment of the present invention. FIG. 1B illustrates a side view of chair sled with a gaming device according to an embodiment of the present invention.

Referring to FIGS. 1A and 1B, a gaming station 100 includes a gaming device 110, a gaming chair 140, and a chair sled 150. The gaming device 110 may be any type of slot machine, video poker machine, or the like. The gaming chair 140 may be configured in any of the known styles associated with gaming or patron comfort. For example, gaming chair 140 may be configured as a simple stool, or may have more luxurious features to aid in player comfort such as high backs, cup holders, speakers, etc. The gaming chair 140 may be connected to the chair sled 150 via a chair support 145 and a support interface 155 on the chair sled 150. The chair support 145 may be configured as a post or pole like structure like that shown in the embodiment illustrated in FIG. 1A, or may be configured in other known manners to provide sturdy support for the gaming chair 140. The support interface 155 may be configured in numerous manners to allow the chair support 145 and the gaming chair 140 to be securely fastened to the chair sled 150. The support interface 155 may include an opening for the chair support 145 to fit into, and may include a tightening apparatus (not shown), such as bolts to secure the chair support 145. In other embodiments, the chair support 145 may be welded or otherwise permanently affixed to the chair sled 150. In still other embodiments, the support interface 155 may have multiple positions so that the casino or player may adjust the distance between the gaming chair 140 and the gaming device 10. In other embodiments, the gaming chair 140 may be adjustable relative to the chair support 145 to accomplish a similar functionality of having the distance between the gaming chair 140 and the gaming device 110 be adjustable.

The chair sled 150 may be configured so that support interface 155 is at a rear end portion 154 of the chair sled 150 while a latching mechanism 170 is at a front end portion 152 of the chair sled 150. The chair sled is preferably low profile and may preferably have side edges that slope downward to prevent players from tripping, stumbling, or otherwise hurting themselves because of the presence of the chair sled 150. The chair sled 150 may also be fairly wide to provide a stable base for the gaming chair 140. The chair sled 150 may have a fixed length or may have a mechanism by which the length of the chair sled 150 can be adjusted. As mentioned above, this length adjustment mechanism may be advantageous in allowing the distance between the gaming chair 140 and the gaming device 110 to be adjustable. This may be advantageous to accommodate players of varying heights or so that one chair sled 150 could be interchangeably used with differently configured gaming devices 110, such as between an upright slot machine and a slant top slot machine.

The base portion 112 of the gaming device 110 includes a slot 120 configured to receive the front end portion 152 of the chair sled 150. The base portion 112 of the gaming device 110 also includes a connector portion 130 that is configured to be latched by the latching mechanism 170 of the chair sled 150. The connector portion 130 may be configured in a variety of configurations to be compatible with the latching mechanism 170 of the chair sled 150. For example, the connector portion 130 may include one or more of a fixed pin, a latch recession, a hook, a latch bar, and a support rail. The slot 120 may be formed by an indentation in the lower edge of the lower portion 112 of the gaming device 110. However, in other embodiments, the slot 120 may be a substantially rectangular shaped opening in the lower portion 112 of the gaming device 110.

The latching mechanism (also referred to as the latching unit) 170 is formed in the chair sled 150. The latching mechanism 170 may preferably be formed in a cavity 160 below a surface of the chair sled 150. This configuration may be preferable because the latching mechanism 170 will not require an additional protrusion above a top surface of the chair sled 150, which may limit foot room or pose a tripping hazard to players. The cavity 160 may open to either the top surface of the chair sled 150 or the bottom surface of the chair sled 150. The embodiment shown in FIG. 1A includes a cavity 160 that is open to the top surface of the chair sled 150. This configuration may be advantageous in allowing easier access to the latching mechanism 170 if it is not working properly. However, having the cavity 160 open to the bottom surface of the chair sled 150 may be advantageous in providing a substantially uniform top surface of the chair sled 150 that may be more visually appealing and help prevent unauthorized access to the latching mechanism 170.

The cavity 160 is preferably covered by a latch cover 190. The latch cover 190 may be advantageous in keeping the latching mechanism 170 free from dirt and other debris. The latch cover 190 may also help prevent unauthorized access to the latching mechanism 170. The cover 190 may be attached to the chair sled via fasteners know in the art, such as bolts, screws, holding tabs, etc.

The latching mechanism 170 may include a portion to engage the connector portion 130 of the gaming device 110 and a portion that allows a technician to engage the latching mechanism in order to manipulate the latching mechanism 170. At least one spring and/or other resistance means 180 may be included in the chair sled 150 to keep the latching mechanism in a locked position. The spring 180 may be included in the cavity 160 along with the latching mechanism 170. The spring 180 may be a rotational spring, a linear spring, a leaf spring, or other spring types known in the art. The choice of spring or resistance member 180 will be determined largely based on the motion of the latching mechanism 170. That is, the spring or resistance member 180 should be configured to resist the movement of the lathing mechanism 170 from a locked to unlocked position. The presence of the spring or resistance means 180 may be preferable because it helps prevent the latching mechanism 170 from becoming unlocked when the chair sled 150 is attached to the gaming device 110 and may help prevent a technician from forgetting to manipulate the latch to a locked position when placing a chair sled 150 into a gaming device 110. In addition, the spring or resistance means 180 may speed up removal and insertion of the chair sleds 150 into gaming devices 110 during floor cleaning or gaming floor reconfigurations.

However, in other embodiments, the spring or resistance means 180 may be omitted. In these embodiments, the latching mechanism 170 may have locked and unlocked positions where movement between them is due to manipulation of the latching mechanism 170 by a technician or gravity. For example, although not illustrated, the latching mechanism 170 may include a progressively widening hook and the connector portion 130 may include an eyebolt or similar structure with an opening, where the pressure generated by latching the hook into the eyebolt may be sufficient for preventing the latching mechanism 170 from becoming unlocked. A small indent or rise on the hook may further aid in preventing the latching mechanism 170 from becoming unlocked when connected to the gaming device 110.

To manipulate the latching mechanism 170, an opening 195A may be present in the top surface of the chair sled 150 or the latch cover 190 to allow a technician to insert a tool and engage the latching mechanism 170. The opening 195A may pass completely through the chair sled 150 to help prevent debris from becoming stuck in the opening 195A and hindering insertion of the tool into the opening 195A. In some embodiments, a tool may not be required to unlock the latching mechanism 170. However, it is preferable that the latching mechanism 170 be configured so that it can only be manipulated between a locked and unlocked position with a common tool, such as a screwdriver or the square end of a ratchet wrench. Using a common tool is advantageous since technicians would not have to carry another special tool to remove a chair sled 150 from a gaming device 110, but players would not likely be able to unlatch the chair sled 150. Different casinos or manufacturers may wish the requirement of a special tool to unlatch the chair sled 150 or some may wish for no use of a tool at all to improve the speed of unlatching. These variations have been contemplated and are included in the scope of embodiments of the present invention.

As mentioned above, one advantage of embodiments of the present invention is that the chair sled 150 is kept to a minimum height, which reduced interference with the player's feet and allows the chair sled 150 to be used with gaming devices 110 that have low profile base portions 112. As FIG. 1B illustrates, some gaming devices 110 have a cutout section 115 that allows players to have leg room. In addition, this cutout section 115 allows a base portion 112 of the gaming device 110 to be used as a foot rest, which may increase circulation in the player's legs and reduce fatigue. However, as FIG. 1B illustrates this gaming device 110 configuration leaves relatively little space for the slot 120 which accepts the chair sled 150. Thus, the low profile of the chair sled 150 in embodiments of the present invention is advantageous over convention chair sled designs that have bulky connection schemes.

FIGS. 2A-2E illustrate various views of a chair sled according to another embodiment of the present invention.

Figure 2A:
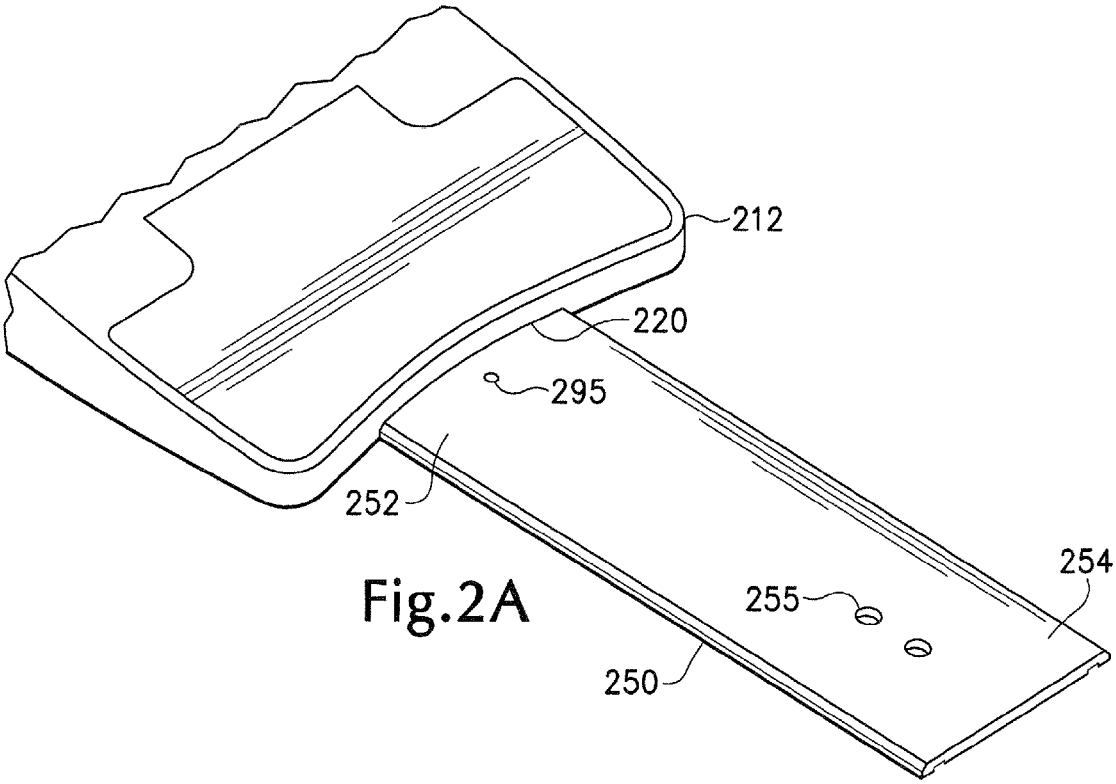
FIG. 2A illustrates a top view of a chair sled connected with a base portion of a gaming device according to an embodiment of the present invention.

FIG. 2A illustrates a top view of a chair sled 250 connected with a base portion 212 of a gaming device according to an embodiment of the present invention. Referring to FIG. 2A, the base portion 212 of the gaming device includes a slot 220 that is configured to accept the front end portion 252 of the chair sled 250. The base portion 212 of the gaming device may also be used as a foot rest for the player. The front end portion 252 of the chair sled 250 includes an opening 295 in the upper surface of the chair sled 250 to allow a technician to manipulate the latching mechanism (not shown) of the chair sled. The back end portion 254 of the chair sled 250 includes the support interface 255 where the gaming chair (not shown) is connected to the chair sled 250. In this embodiment, the support interface 255 includes two openings.

Figure 2B:
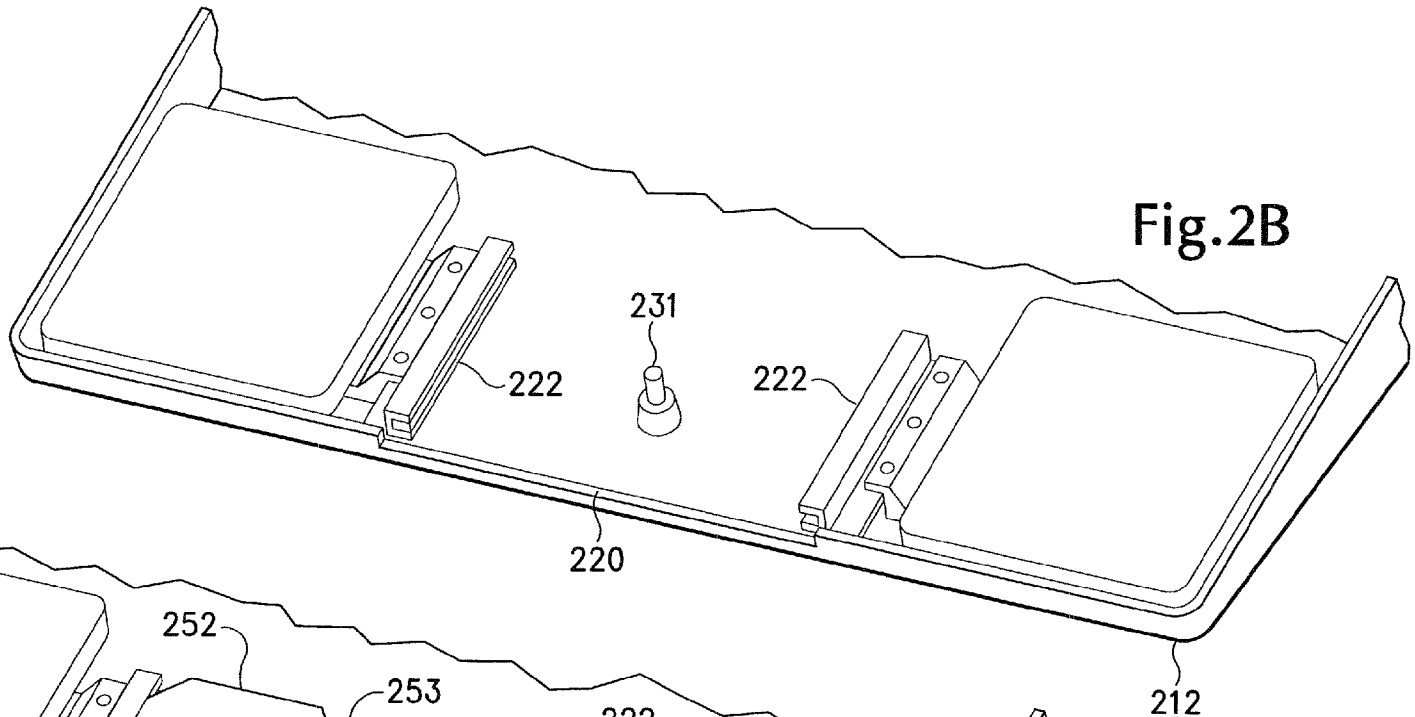
FIG. 2B illustrates a bottom view of the base portion of the gaming device shown in FIG. 2A.

FIG. 2B illustrates a bottom view of the base portion 212 of the gaming device shown in FIG. 2A. Referring to FIG. 2B, the base portion 212 of the gaming device includes a slot 220. In this embodiment, the slot 220 is a recessed portion of the lower front edge of the lower portion 212 of the gaming device. The lower portion 212 of the gaming device also includes a connector pin 231 and rails 222. The connector pin 231 is the point by which the latching mechanism of the chair sled can latch. The connector pin 231 is preferably attached to the base portion 212 of the gaming device to be rigidly fixed so that repeated latching and unlatching of the chair sled do not bend or harm the connector pin 231. The rails 222 are aligned with the outer edges of the slot 220 to accept the sides of the front end portion of the chair sled. The rails 220 be formed to hold and support the font edges of the chair sled and may prevent lateral or vertical rocking or other movement of the chair sled. To aid in this endeavor, the rails 220 should be positioned to minimize the distances between the rails 222 and the chair sled edges. In other words, a tighter tolerance is preferred between the rails 222 and the chair edges to prevent movement of the chair sled relative to the gaming device.

Figure 2C:
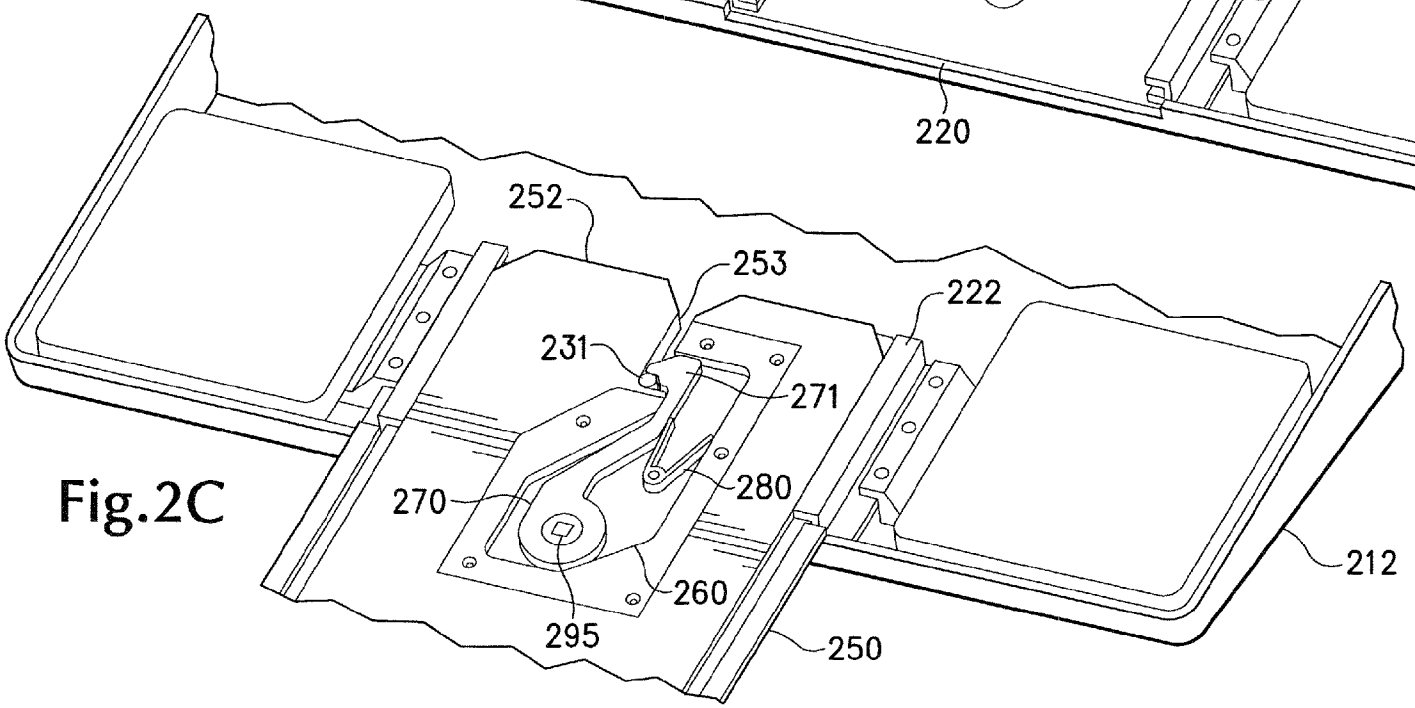
FIG. 2C illustrates a bottom view of the base portion of the gaming device shown in FIGS. 2A and 2B with the chair sled shown in FIG. 2A connected.

FIG. 2C illustrates a bottom view of the base portion 212 of the gaming device shown in FIGS. 2A and 2B with the chair sled 250 shown in FIG. 2A connected. Referring to FIG. 2C, the front end portion 252 of the chair sled 250 is inserted into the base portion 212 of the gaming device so that the latching mechanism 270 is latching the connector pin 231 in a locked position. The front end portion 252 of the chair sled 250 includes a pin slot 253 that allows the connector pin to pass up to the latching mechanism 270. The latching mechanism 270 is recessed in a cavity 260 of the chair sled 250. Here, the cavity 260 is in the lower surface of the chair sled and opens towards floor when placed in operation with a gaming device.

In this embodiment, the latching mechanism 270 includes a hook portion 271 that latches around the connector pin 231 to prevent the chair sled 250 from being removed from the base portion 212 of the gaming device. The hook portion 271 of the latching mechanism 270 may also include a sloped front surface to allow the connector pin to push the latching mechanism open when the chair sled 250 is inserted into the bottom portion 212 of the gaming device. This feature, which eliminates the need for a technician to use a tool when placing a chair sled 250 into a gaming device, may improve the speed and ease of moving the chair sled relative to the gaming device.

The chair sled 250 also includes a spring 280 that provides resistance to keep the latching mechanism 270 in a locked position. Since the latching mechanism 270 of this embodiment, uses a rotational motion to go from a locked to unlocked position, the spring 280 is positioned to oppose this rotational movement. The opening 295 shown in the top surface of the chair sled in FIG. 2A corresponds to the opening 295 in the latching mechanism 270. This opening 295 is configured to allow a tool, such as the square end of a ratchet wrench to be inserted. A technician with such a tool may then rotate the tool to manipulate the latching mechanism 270 from a locked to unlocked position. In an unlocked position, the hook portion 271 of the latching mechanism 270 is rotated toward the spring 280 to compress the spring 280 and allow the connected pin 231 to travel down the pin slot 253 when the chair sled 250 is pulled away from the base portion 212 of the gaming device.

As shown in FIG. 2C, the rails 222 closely align with the edges of the front end portion 252 of the chair sled 250. The edges of the front end portion 252 of the chair sled 250 may be laterally recessed from the edges of the rest of the chair sled 250 (i.e., slightly narrower) to create a sled stop 258 (shown in FIG. 2E) that prevents the chair sled from being inserted too far in the base portion 212 of the gaming device. The chair stop 258 may also help prevent lateral rocking movement of the chair sled 250 relative to the gaming device. The edges of the chair sled 250 may also be vertically recessed from the rest of the chair sled 250 (i.e., slightly thinner) to create less of a lip 257 (shown in FIG. 2E) when placed on carpet on a gaming floor.

Figure 2E:
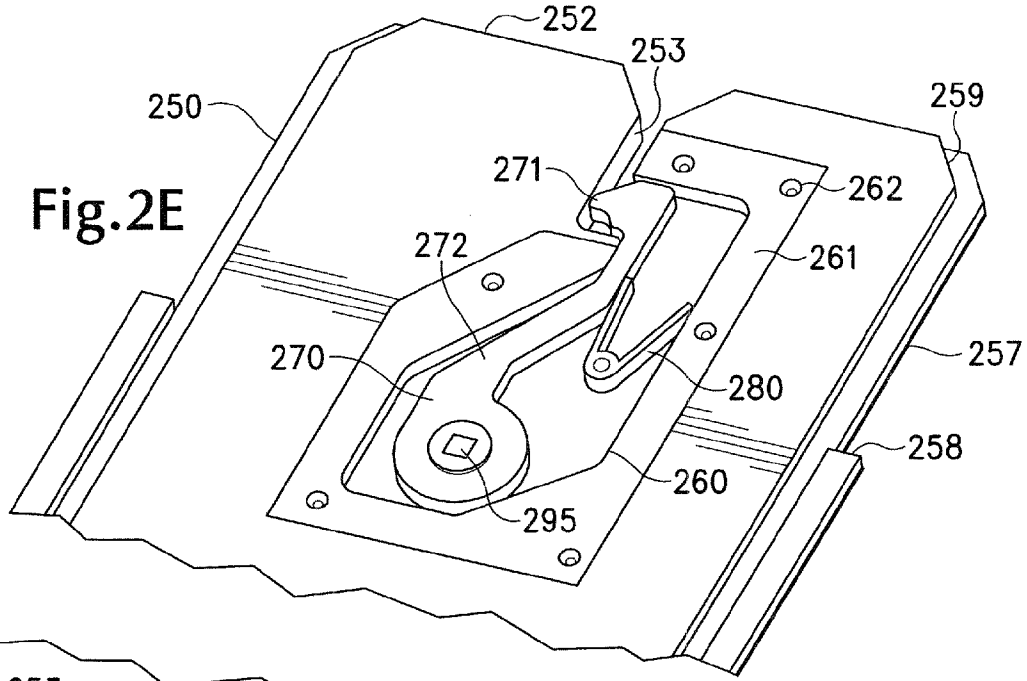
FIG. 2E is a close up of the front end portion of the chair sled shown in FIG. 2C.
Figure 2D:
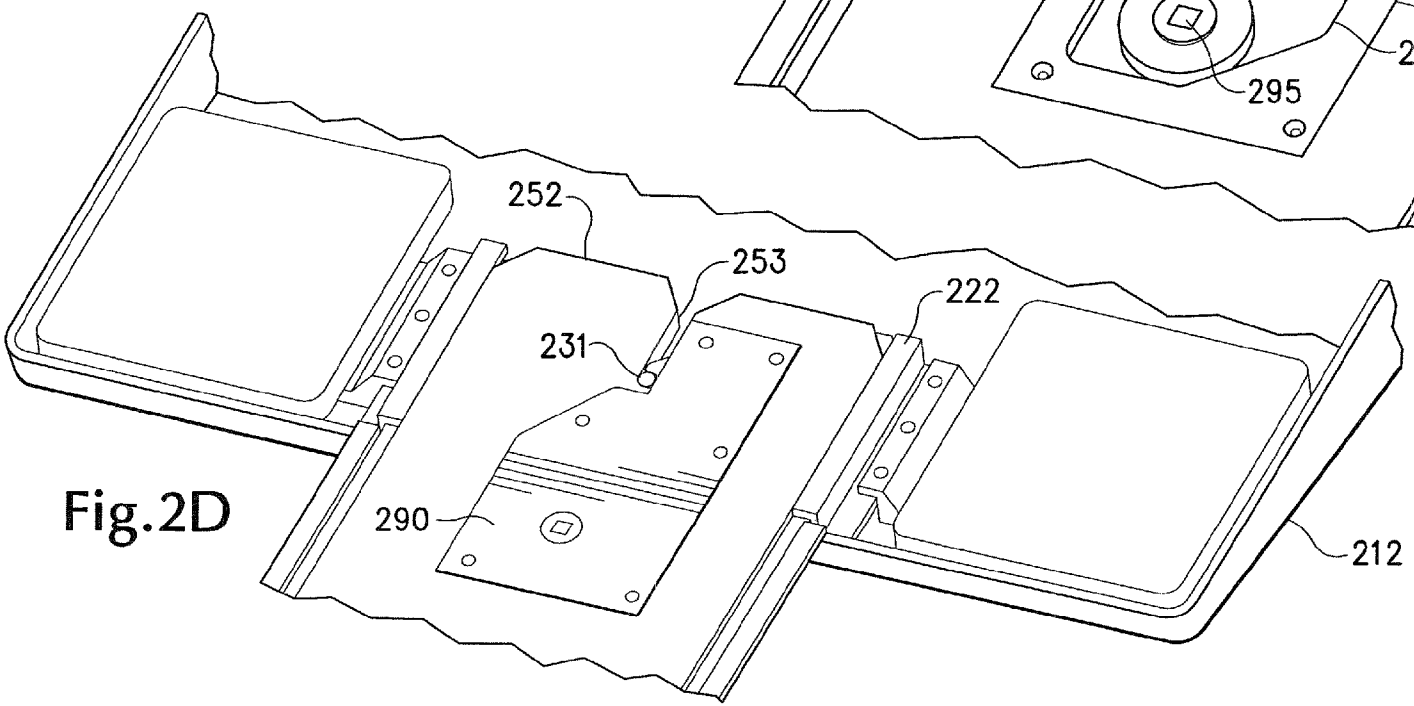
FIG. 2D illustrates a bottom view of the base portion of the gaming device and chair sled shown in FIG. 2C with the latch cover in place.

FIG. 2D illustrates a bottom view of the base portion 212 of the gaming device and chair sled 250 shown in FIG. 2C with the latch cover 290 in place. Referring to FIG. 2D, the latch cover 290 covers the cavity 260 shown in FIG. 2C to protect the latching mechanism 270 from dirt or other debris on the gaming floor. The latch cover 290 may include an opening over the pin slot 253 in case the connector pin 231 is longer than the thickness of the of the front end portion 252 of the chair sled 250. However, in other embodiments, the latch cover 290 may be configured to cover the bottom portion of the pin slot 253.

FIG. 2E is a close up of the front end portion 252 of the chair sled 250 shown in FIG. 2C. Referring to FIG. 2E, the front end portion 252 of the chair sled 250 includes the latching mechanism 270 and the spring 280 disposed in the cavity 260. In this embodiment the cavity 260 opens up to the bottom surface of the chair sled 250. The latching mechanism 270 includes a hook portion 271, a body portion, 272, and an opening 295. The hook portion 271 is configured to hold the connector pin 231 (shown in FIG. 2C) of the gaming device when the chair sled 250 is inserted into the base portion 212 (shown in FIG. 2C) of the gaming device. The body portion 272 of the latching mechanism 270 is connected to the hook portion 271 and moves the hook portion 271 when the latching mechanism 270 is manipulated by a technician. The opening 295 is configured to interface with a common tool so that a technician can manipulate the latching mechanism 270. The latching mechanism rotates about a pivot point centered in the opening 295.

The spring 280 is disposed between the body portion 272 of the latching mechanism 270 and a sidewall of the cavity 260. The spring 280 is configured to resist rotation of the latching mechanism 270 and to maintain the latching mechanism 270 in a locked position. The perimeter of the cavity 260 includes a cover recess 261 that allows the latch cover 290 (shown in FIG. 2D) to lie substantially flush with the bottom surface of the chair sled 250. One or more cover attachment points 262 may be present so that the latch cover 290 can be securely attached to the chair sled 250.

The front end portion 252 of the chair sled 250 also includes the pin slot 253 that allows the connector pin 231 of the gaming device to be engaged by the latching mechanism 270. The front end portion 252 also includes a chair stop 258 and a lip 257. The chair stop 258 may help prevent the chair sled 250 from being inserted too far in the base portion 212 of the gaming device and damaging the connector pin 231. The lip 257 may help the chair sled 250 better interface with the rails 222 (shown in FIG. 2C) and may help edges of the chair sled 250 to sit substantially flush with the carpet on a gaming floor. The front end portion 252 may also include self aligning corners 259, which help align the chair sled 250 with the rails 222 when the chair sled 250 is inserted into the base portion 212 of the gaming device.

FIGS. 3A-3H illustrate various views of a chair sled according to yet another embodiment of the present invention.

Figure 3A:
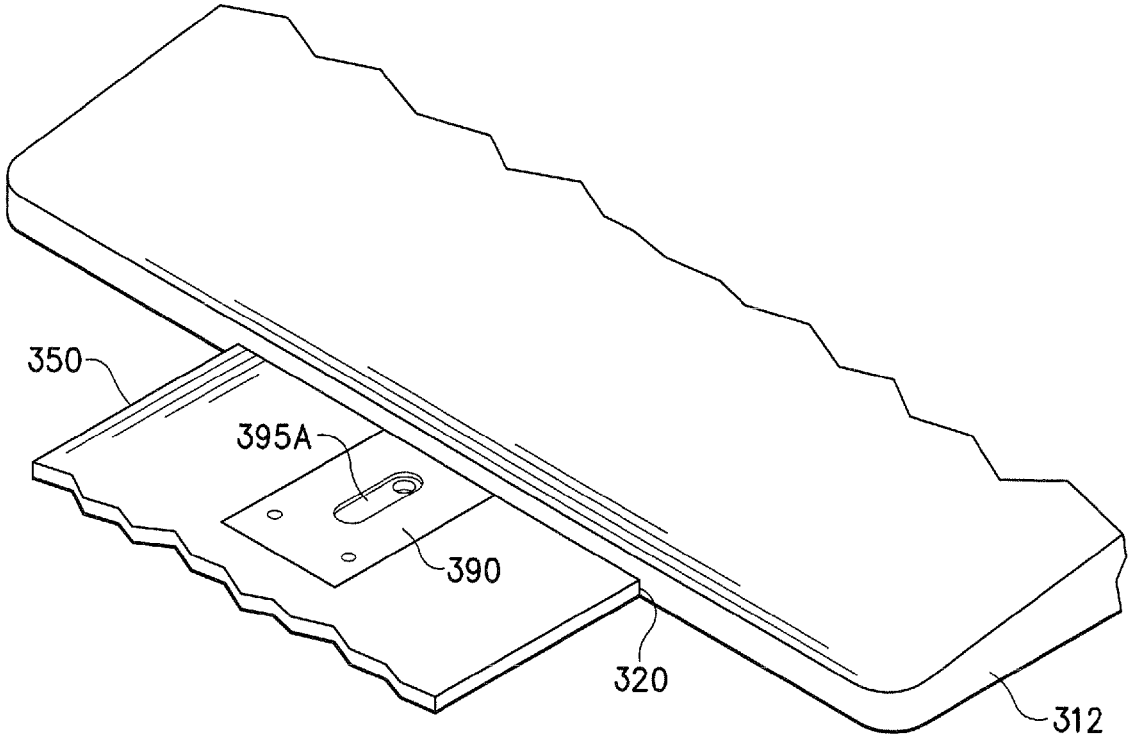
FIG. 3A illustrates a top view of a chair sled connected with a base portion of a gaming device according to another embodiment of the present invention.

FIG. 3A illustrates a top view of a chair sled 350 connected with a base portion 312 of a gaming device according to another embodiment of the present invention. Referring to FIG. 3A, the base portion 312 of the gaming device includes a slot 320 that is configured to accept the front end portion 352 of the chair sled 350. The base portion 312 of the gaming device may also be used as a foot rest for the player. The front end portion 352 of the chair sled 350 includes an opening 395A in a latch cover 390 to allow a technician to manipulate the latching mechanism (not shown) of the chair sled.

Figure 3B:
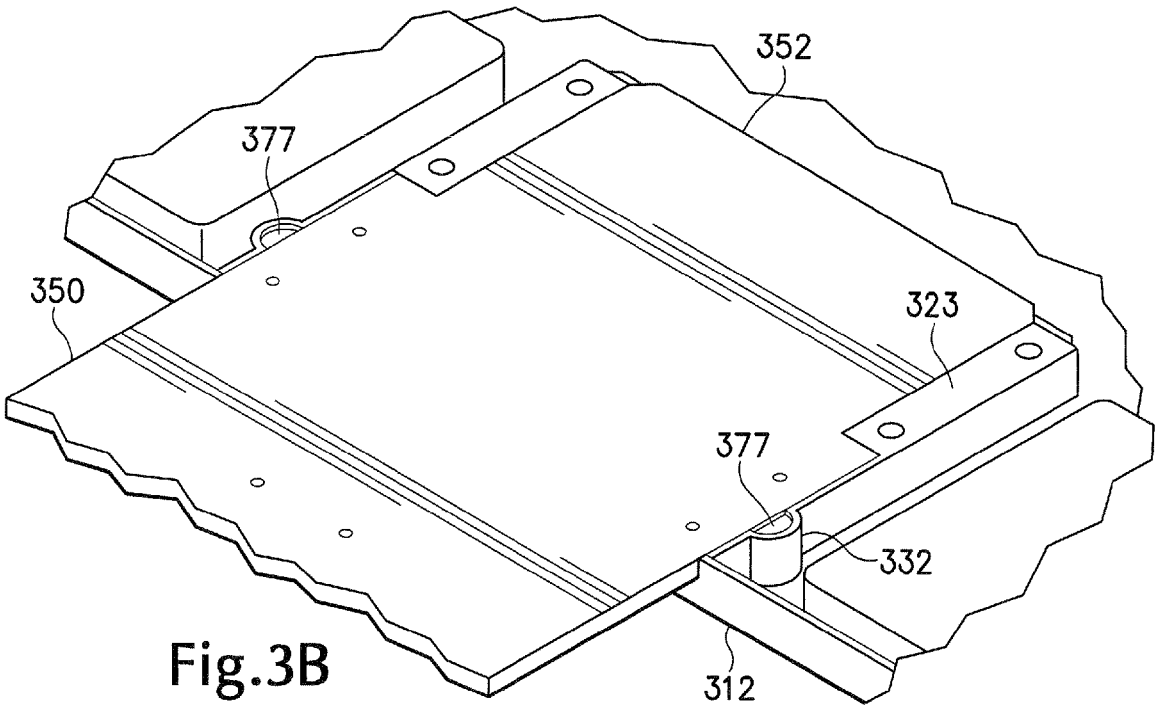
FIG. 3B illustrates a bottom view of the base portion of the gaming device shown in FIG. 3A while connected with the chair sled shown in FIG. 3A.

FIG. 3B illustrates a bottom view of the base portion 312 of the gaming device shown in FIG. 3A while connected with the chair sled 350 shown in FIG. 3A. Referring to FIG. 3B, the front end portion 352 of the chair sled 350 is latched with the base portion 312 of the gaming device. Latch bars 377 protruding from lateral edge portions of the chair sled 350 extend into connector recessions 332 that are formed in the base portion 312 of the gaming device to secure the chair sled 350 in the gaming device. When the latching mechanism (shown in FIG. 3C) is manipulated to an unlocked position, the latch bars 377 are retracted into the chair sled 350 so that a technician may easily remove the chair sled 350 from the gaming device. The base portion 312 of the gaming device also includes rails 323 to help prevent lateral and vertical rocking or movement of the chair sled 350 when it is connected to the gaming device. Similarly to the embodiment shown in FIGS. 2A-2E, it is preferable to have the tolerance between the edges of the chair sled 350 and the rails 323 as small as possible to minimize any movement of the chair sled 350. The rails 323 may also help align the chair sled 350 with the base portion 312 of the gaming device so that the latch bars 377 properly latch in the connector recessions 332.

Figure 3C:
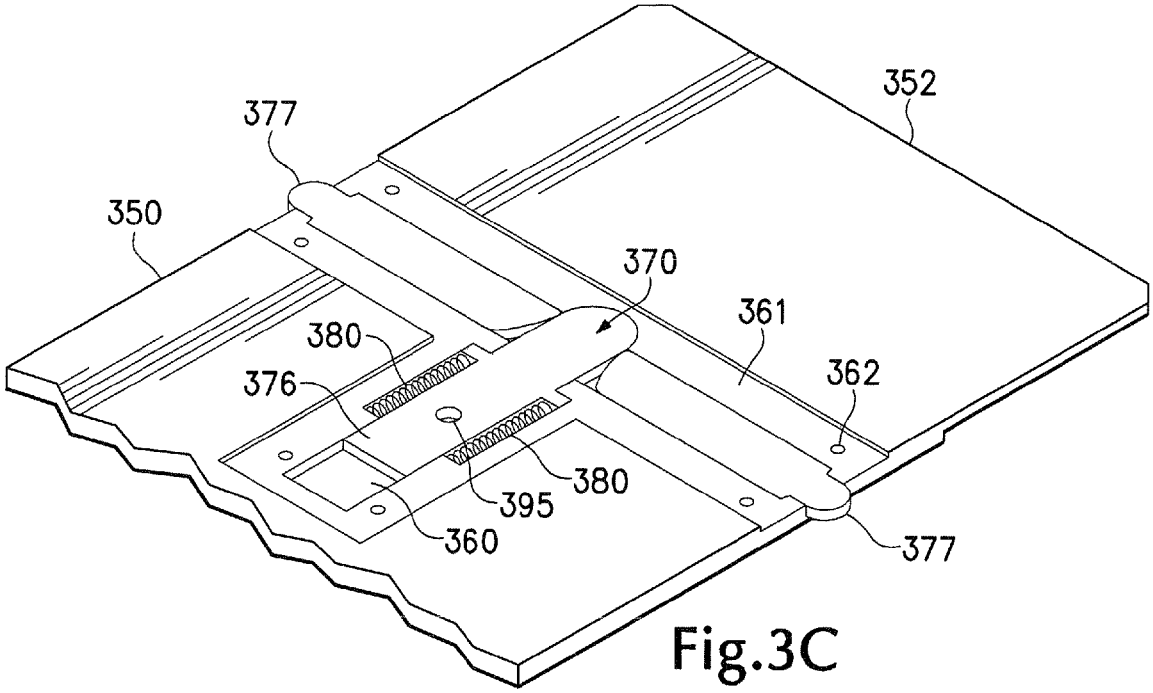
FIG. 3C illustrates a top view of the chair sled shown in FIG. 3A in a locked position.

FIG. 3C illustrates a top view of the chair sled 350 shown in FIG. 3A in a locked position. Referring to FIG. 3C, the front end portion 352 of the chair sled 350 includes a cavity 360 that opens to the upper surface of the chair sled 350. In this embodiment, the cavity 360 is substantially T-shaped. The cavity 360 may also include a cover recess 361 that allows the latch cover 390 (shown in FIG. 3E) to be substantially coplanar with the top surface of the chair sled 350. One or more cover attachment points 362 may be present so that the latch cover 390 can be securely attached to the chair sled 350.

A latching mechanism 370 is disposed in the cavity 360. The latching mechanism 370 includes at least two latching bars 377 and a latch trigger 376. The latch trigger 376 moves along a longitudinal direction of the chair sled 150. The latching bars 377 move in a lateral direction to the latch trigger 376 and extend past edge portions of the chair sled 350 when they are disposed in a locked position. The latch trigger 376 includes an end that is configured to interface with the latch bars 377. In a locked position, as is shown in FIG. 3C, the latch trigger 376 is disposed toward the latch bars 377 and forces the latch bars 377 to extend past the edges of the chair sled 350. The latch trigger 376 also includes an opening 395, which is configured to accept a tool to allow a technician to manipulate the latching mechanism 370.

One or more springs 380 may also be disposed in the cavity 360 to help keep the latching mechanism 370 in a locked position. In the embodiment illustrated in FIG. 3C, two springs are positioned to press the latch trigger 376 toward the latch bars 377 so that the latching mechanism 370 is in a locked position. These springs 380 are configured to linearly resist the latch trigger from being retracted to an unlocked position, which is shown in FIG. 3D.

Figure 3D:
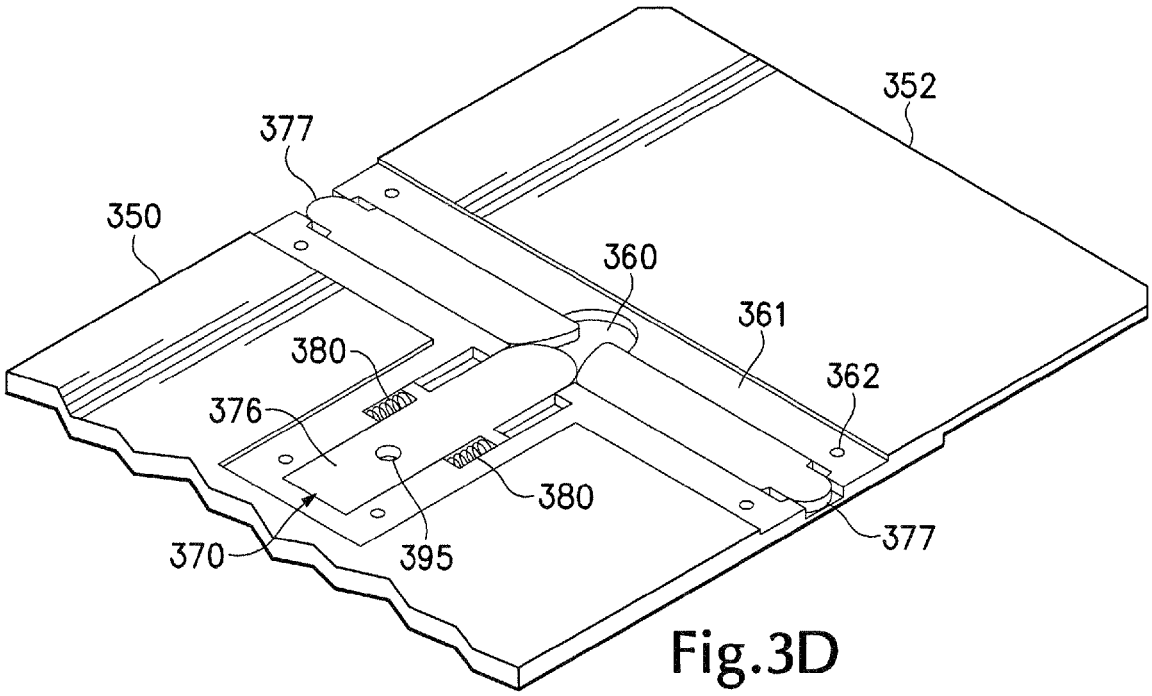
FIG. 3D illustrates a top view of the chair sled shown in FIG. 3C in an unlocked position.

FIG. 3D illustrates a top view of the chair sled 350 shown in FIG. 3C in an unlocked position. Referring to FIG. 3D, when the latch trigger 376 is retracted in the cavity 360, the latch bars are allowed to recede inside the edges of the chair sled 350; thus, allowing the chair sled 350 to be released from the base portion 312 of the gaming device.

Figure 3E:
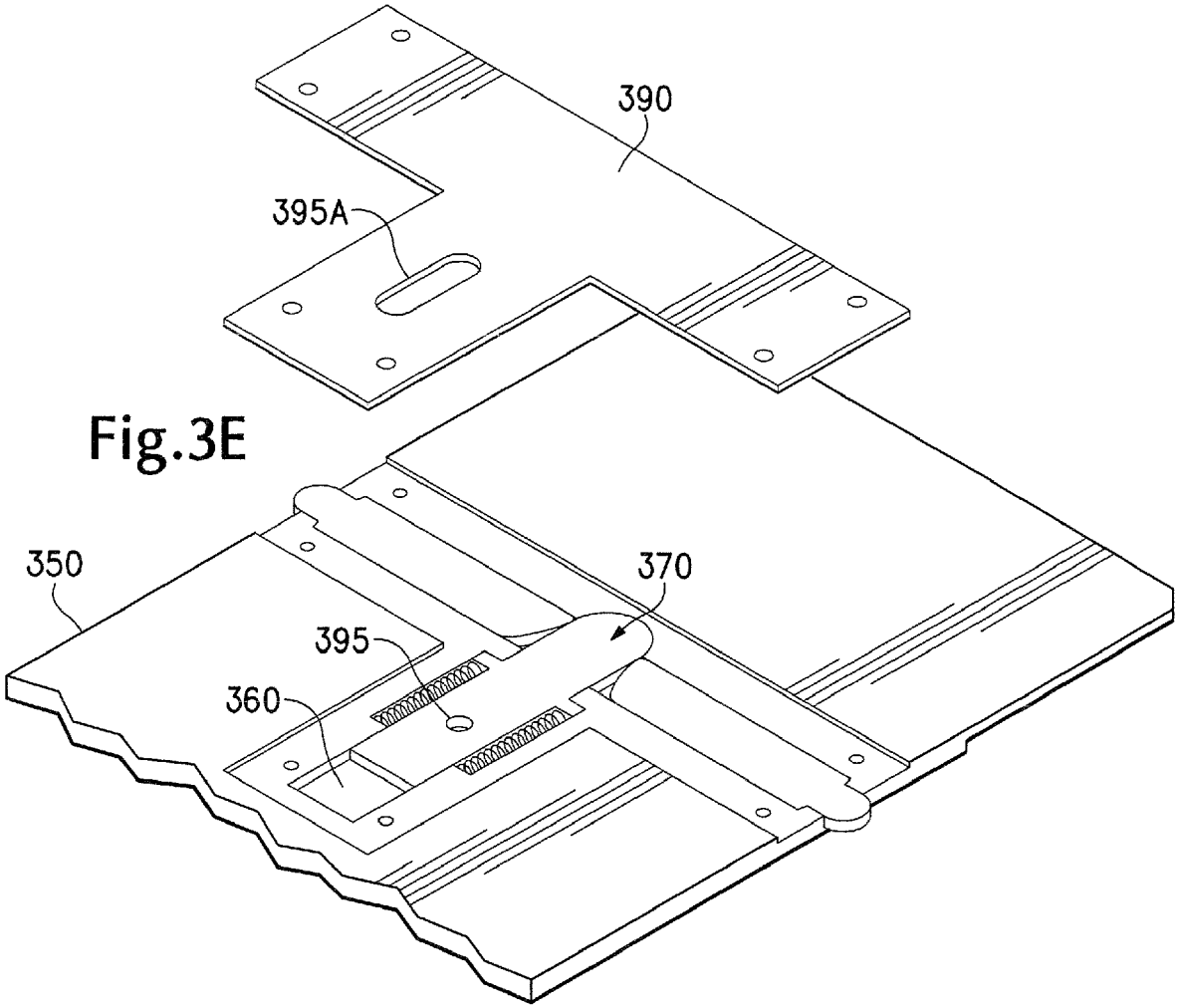
FIG. 3E illustrates a top view of the chair sled shown in FIG. 3C with a latch cover.

FIG. 3E illustrates a top view of the chair sled 350 shown in FIG. 3C with a latch cover 390. Referring to FIG. 3E, the latch cover 390 is configured to cover the latching mechanism 370 to prevent dirt and other debris from interfering with the latching mechanism 370. In addition, since the cavity 360 opens up to the top surface of the chair sled 350, the latch cover 390 may help prevent players or other unauthorized personnel from accessing the latching mechanism 370. The latching mechanism 390 may also include a slot opening 395A that allows a technician access to the opening 395 by which he can insert a tool and retract the latching mechanism 370 to an unlocked position. The slot opening 395A preferably is long enough to allow a technician to engage the opening 395 of the latching mechanism 370 and manipulate the latching mechanism 370 to an unlocked position.

Figure 3F:
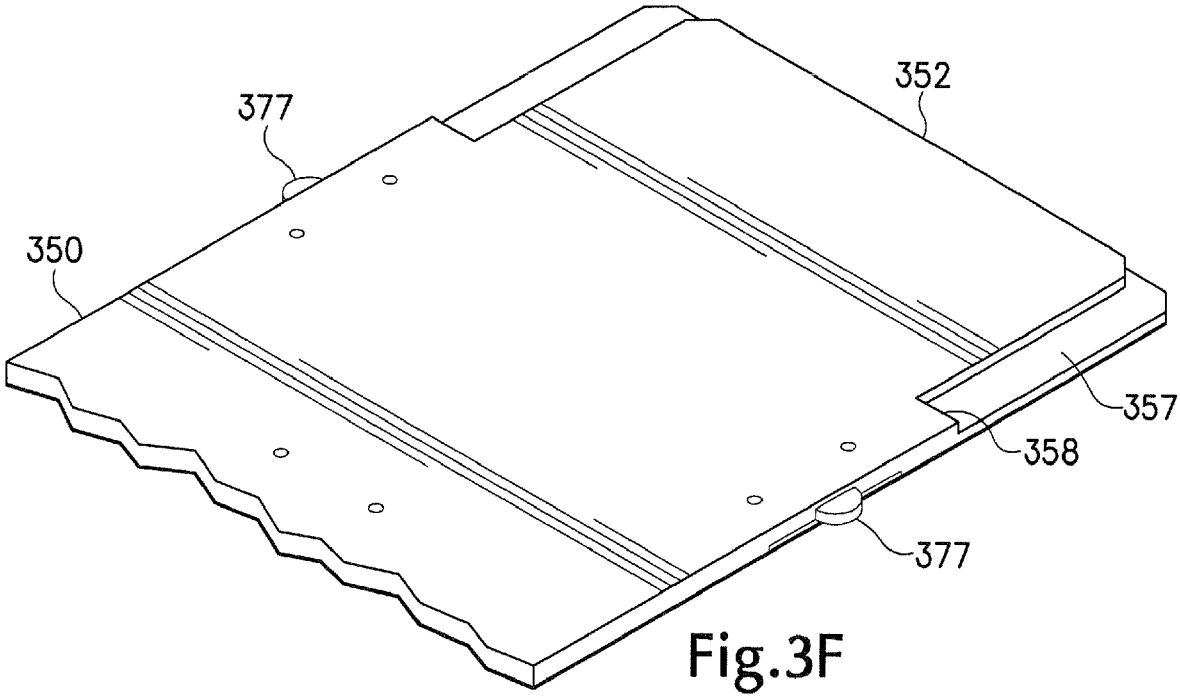
FIG. 3F illustrates a bottom view of the chair sled shown in FIG. 3C.

FIG. 3F illustrates a bottom view of the chair sled 350 shown in FIG. 3C. Referring to FIG. 3F, the front end portion 352 of the chair sled 350 may also include a recessed lip 357. The lip 357 may help the chair sled 350 better interface with the rails 323 (shown in FIG. 3B). The end 358 of the recessed lip 357 may act as a sled stop to prevent the chair sled 350 from being inserted too far in the base portion 312 of the gaming device. The sled stop 358 may also help align the latch bars with the connector recesses 332 to ensure that the chair sled 350 is properly latched with the gaming device.

Figure 3G:
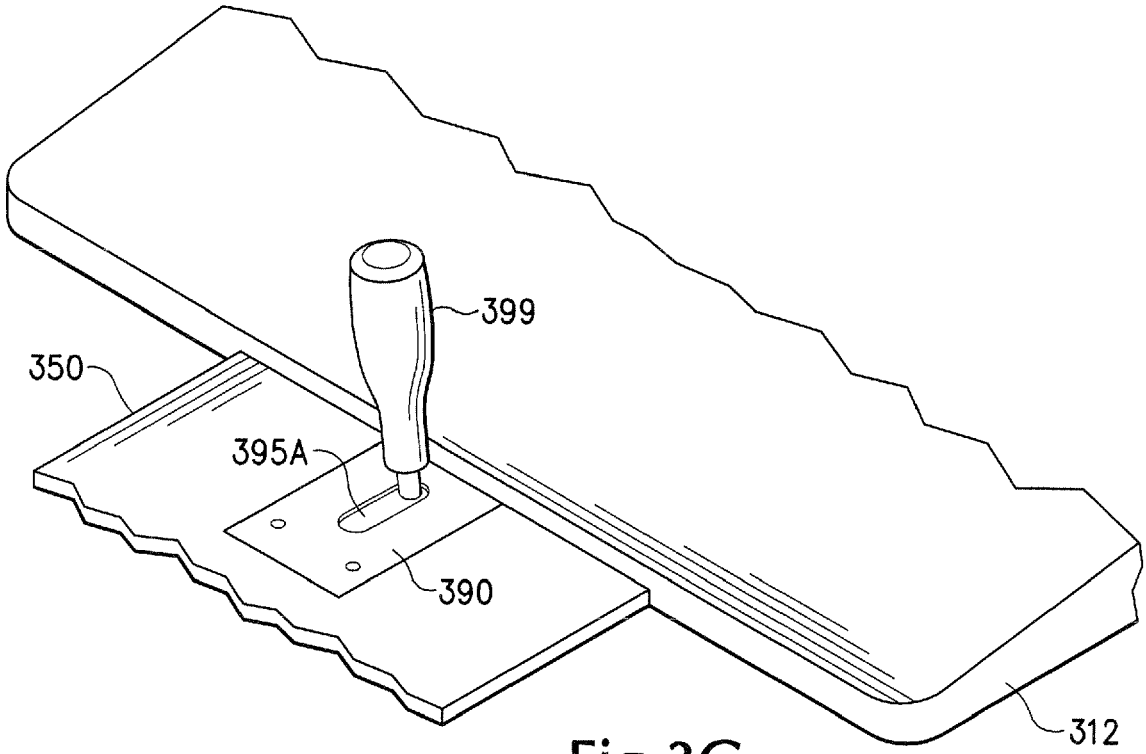
FIG. 3G illustrates the chair sled shown in FIG. 3A with a tool inserted into a latch cover opening.

FIG. 3G illustrates the chair sled 350 shown in FIG. 3A with a tool 399 inserted into a latch cover slot opening 395A. Referring to FIG. 3G, a common tool 399, such as screwdriver, may be inserted in the slot opening 395A in the latch cover 390 to engage the opening 395 in the latching mechanism 370 (shown in FIG. 3C). In this figure, the latching mechanism 370 is in a locked position.

Figure 3H:
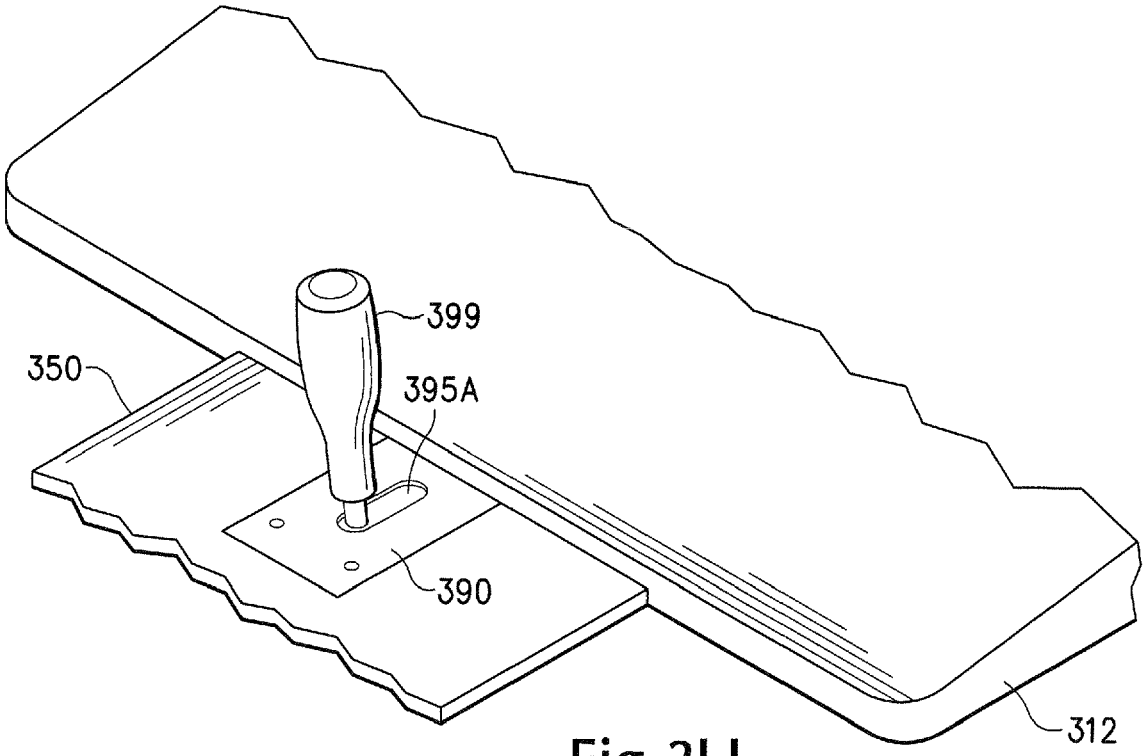
FIG. 3H illustrates the chair sled shown in FIG. 3G with the tool manipulated to unlock the chair sled.

FIG. 3H illustrates the chair sled 350 shown in FIG. 3G with the tool 399 manipulated to unlock the chair sled 350. Referring to FIG. 3H, the tool 399 has been disposed away from the base portion 312 of the gaming device to retract the latching mechanism 370 and allow the chair sled 350 to be removed from the gaming device.

Having described and illustrated the principles of the invention in embodiments thereof, it should be apparent that the invention can be modified in arrangement and detail without departing from such principles. I claim all modifications and variations coming within the spirit and scope of the following claims.

The invention claimed is:

1. A chair sled coupling a gaming chair to a gaming device, the chair sled comprising:

a sled body having an upper surface and a lower surface, the sled body including a chair attachment connector disposed at a first end of the sled body and a cavity disposed at a second end of the sled body;

a latching unit disposed in the cavity of the sled body, the latching unit configured to latch with a connector portion of the gaming device;

a spring disposed in the cavity of the sled body, the spring configured to hold the latching unit in a locked position; and a latch cover configured to cover the cavity of the sled body, wherein at least one of the latch cover or sled body includes an opening for an operator to manipulate the latching unit to an unlocked position.

2. The chair sled of claim 1, wherein the second end of the sled body is configured to be inserted into a slot in a base portion of the gaming machine.

3. The chair sled of claim 2, wherein the second end of the sled body includes recessed edge portions configured to interface with rails disposed in the base portion of the gaming device.

4. The chair sled of claim 3, wherein the recessed edge portions of the sled body include self-aligning portions.

5. The chair sled of claim 3, wherein the recessed edge portions of the sled body further include a sled stop to stop the sled at a predetermined insertion depth when the chair sled is inserted into the slot in the base portion of the gaming device.

6. The chair sled of claim 1, wherein the latching unit comprises:

a first latch bar configured to laterally protrude from the second end of the sled body;

a second latch bar configured to laterally protrude from the second end of the sled body in an opposite direction from the first latch bar; and a latch trigger positioned between the first and second latch bars, the latch trigger configured to be manipulated in a direction perpendicular to the first and second latch bars to retract the first and second latch bars.

7. The chair sled of claim 6, wherein the connector portion of the gaming device includes connector recessions configured to interface with the first and second latch bars of the chair sled to latch the chair sled with the gaming device.

8. The chair sled of claim 1, wherein the latching unit comprises:

a rotatable latch body formed with a substantially central pivot point; and a latching arm extending from the latch body, the latching arm including a hook portion.

9. The chair sled of claim 8, wherein the connector portion of the gaming device includes a connector pin configured to interface with the hook portion of the latching unit to latch the chair sled with the gaming device.

10. The chair sled of claim 8, wherein the spring is a rotational spring configured to apply rotational force on the latching unit.

11. The chair sled of claim 1, wherein the cavity is formed in the upper surface of the sled body.

12. The chair sled of claim 11, wherein the opening for the operator is a slot opening formed in the latch cover.

13. The chair sled of claim 1, wherein the cavity is formed in the lower surface of the sled body.

14. The chair sled of claim 13, wherein the opening for the operator to manipulate the latching unit is formed in the upper surface of the sled body.

15. The chair sled of claim 1, wherein the opening is configured to allow a tool to he inserted into the latching unit, the opening configured to pass completely through the chair sled.

16. A sled coupling a chair to a gaming device, the sled comprising:

a sled body including means for attaching the chair to the sled;

latching means for locking the sled to the gaming device, the latching means configured to engage a connector pin of the gaming device to lock the sled to the gaming device; and an opening configured to allow an operator to release the latching means to unlock the sled from the gaming device.

17. The sled of claim 16, further comprising a spring configured to hold the latching means in a locked position.

18. A chair attachment system for a gaming device, the chair attachment system including:

a gaming chair;

a sled body including means for attaching the gaming chair to the sled body and including a cavity;

a latching unit disposed in the cavity of the sled body;

a spring disposed in the cavity of the sled body, the spring configured to maintain the latching unit in a locked position; and a latch cover configured to cover the cavity of the sled body, wherein a portion of the sled body including the latching unit is configured to be inserted into a base portion of the gaming device to lock the sled body to the gaming device.

19. The chair attachment system of claim 18, wherein the base portion of the gaming device includes a slot in which the portion of the sled body including the latching unit is inserted.

20. The chair attachment system of claim 19, wherein the slot includes a raised portion of a lower edge of the base portion of the gaming device.

21. The chair attachment system of claim 18, wherein the latch cover includes an opening configured to interface with a tool for manipulating the latching unit to an unlocked position.

22. The chair attachment system of claim 18, wherein the sled body includes an opening configured to interface with a tool for manipulating the latching unit to an unlocked position.

23. The chair attachment system of claim 18, wherein the sled body includes a cover recess where the latch cover is substantially coplanar with one of the top or bottom surface of the sled body.

* * * * *